US005192422A

United States Patent [19]

So

[11] Patent Number: 5,192,422

[45] Date of Patent: Mar. 9, 1993

[54] OIL SHALE BENEFICIATION PROCESS USING A SPIRAL SEPARATOR

[75] Inventor: Bernard Y. C. So, Wheaton, Ill.

[73] Assignee: Amoco Corporation, Chicago, Ill.

[21] Appl. No.: 817,794

[22] Filed: Dec. 31, 1991

[51] Int. Cl.[5] ..... B03B 5/62; B03B 7/00; B03D 1/02

[52] U.S. Cl. ..... 209/164; 209/166; 209/10; 209/17; 209/459; 241/20; 241/21; 241/24; 208/425; 208/426

[58] Field of Search ..... 209/10, 11, 12, 17, 209/459, 164, 166; 241/21, 24, 20; 208/425, 426, 390, 391

[56] References Cited

U.S. PATENT DOCUMENTS

| | | | |
|---|---|---|---|
| 2,952,360 | 9/1960 | Oberg | 209/459 |
| 3,891,546 | 6/1975 | Humphries | 209/459 |
| 3,973,734 | 8/1976 | Rosar | 241/20 |
| 4,128,474 | 12/1978 | Ennis | 209/211 |
| 4,176,042 | 11/1979 | Fahlstrom | 208/426 |
| 4,348,274 | 9/1982 | Guerre | 241/24 |
| 4,441,984 | 4/1984 | Guerre | 208/415 |
| 4,460,376 | 7/1984 | Fahlstrom | 209/164 |
| 4,466,882 | 8/1984 | Audeh | 208/426 |
| 4,506,835 | 3/1985 | Tsai | 241/21 |
| 4,528,090 | 7/1985 | Tsui | 241/24 |
| 4,576,708 | 3/1986 | Oko | 208/426 |
| 4,667,885 | 5/1987 | Datta | 241/21 |
| 4,673,133 | 6/1987 | Datta | 241/20 |
| 4,963,250 | 10/1990 | So | 241/21 |
| 4,968,413 | 11/1990 | Datta | 209/166 |
| 5,000,389 | 3/1991 | So | 241/21 |
| 5,091,076 | 2/1992 | So | 208/426 |

OTHER PUBLICATIONS

"Oil Shale Beneficiation for Above Grand Retorting" by Moudgil et al. Mining Engineering, Sep. 1982, 1336–1338.

*Primary Examiner*—Stanley S. Silverman
*Assistant Examiner*—Thomas M. Lithgow
*Attorney, Agent, or Firm*—Scott P. McDonald; Richard A. Kretchmer; Frank J. Sroka

[57] ABSTRACT

A stream containing kerogen-rich and mineral-rich oil shale particles flow in a downward helical course such that the stream is confined in a manner to give the stream an outer and upper side having a first depth and comprising a substantial amount of said kerogen-rich particles, and an inner and lower side having a second depth and comprising a substantial amount of said mineral-rich particles, the first depth being greater than the second depth. The kerogen-rich and mineral-rich particles are subsequently separated in order to recover the kerogen-rich particles. The mineral-rich particles are further processed using froth flotation.

19 Claims, 1 Drawing Sheet

OIL SHALE BENEFICIATION PROCESS USING A SPIRAL SEPARATOR

FIELD OF THE INVENTION

The present invention is a method of beneficiating oil shale comprising the steps of: comminuting the oil shale in the presence of a first liquid to form a first stream comprising a first group of kerogen-rich particles, a first group of mineral-rich particles, and the first liquid, said kerogen-rich particles having a specific gravity less than that of said mineral-rich particles; flowing said stream in a downward helical course such that the stream is confined in a manner to give the stream an outer and upper side having a first depth and comprising said kerogen-rich particles, and an inner and lower side having a second depth and comprising said mineral-rich particles, said first depth being greater than said second depth; separating said kerogen-rich particles from said mineral-rich particles; and retorting said kerogen-rich particles.

BACKGROUND OF THE INVENTION

In view of the recent instability of the price of crude oil and natural gas, there has been renewed interest in alternate sources of energy and hydrocarbons. Much of this interest has been centered on recovering hydrocarbons from solid hydrocarbon material such as oil shale, coal, and tar sands by pyrolysis or upon gasification to convert the solid hydrocarbon-containing material into more readily useable gaseous and liquid hydrocarbons.

Vast reserves of hydrocarbons in the form of oil shales exist throughout the United States. The Green River formation of Colorado, Utah, and Wyoming is a particularly rich deposit and includes an area in excess of 16,000 square miles. It has been estimated that an equivalent of 7 trillion barrels of oil are contained in oil shale deposits in the United States, almost sixty percent located in the Green River oil shale deposits. The remainder is largely contained in the leaner Devonian-Mississippi black shale deposits which underlie most of the eastern part of the United States.

Generally, oil shale is a fine-grained sedimentary rock stratified in horizontal layers with a variable richness of kerogen content. Kerogen has limited solubility in ordinary solvents and therefore cannot be readily recovered by simple extraction. Upon heating oil shale to a sufficient temperature, however, kerogen can be thermally decomposed to liberate vapors, mist, or liquid droplets of shale oil and light hydrocarbon gases such as methane, ethane, ethene, propane, and propene, as well as other products such as hydrogen, nitrogen, carbon dioxide, carbon monoxide, ammonia, steam and hydrogen sulfide. After such a process, however, a carbon residue typically remains on the retorted shale.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), Union B, Chevron STB, gas combustion and fluid bed. Process heat requirements for surface retorting processes may be supplied either directly or indirectly.

Directly heated surface retorting processes, such as the N-T-U, Kiviter, Fusham and gas combustion processes, rely on the combustion of some form of fuel, such as recycled gas or residual carbon in the spent shale, with air or oxygen within the bed of shale in the retort to provide sufficient heat for retorting. Directly heated surface retort processes usually result in lower product yields due to unavoidable combustion of some of the products and product stream dilution with the products of combustion. The Fusham process is shown and described at pages 101–102, in *Oil Shales and Shale Oils*, by H. S. Bell, published by D. Van Norstrand Company (1948). The other processes are shown and described in the *Synthetic Fuels Data Handbook*, by Cameron Engineers, Inc. (second edition, 1978).

Indirectly heated surface retorting processes, such as the Petrosix, Lurgi-Ruhrgas, Tosco II and Galoter processes, utilize a separate furnace for heating solid or gaseous heat-carrying material which is injected, while hot, into the shale in the retort to provide sufficient heat for retorting. In the Lurgi-Ruhrgas process and some other indirect heating processes, raw hydrocarbon-containing solid, e.g., oil shale or tar sand, and a hot heat carrier, such as spent shale or sand, are mechanically mixed and retorted in a screw conveyor. Such mechanical mixing often results in high temperature zones conducive to undesirable thermal cracking of vapor product as well as causing low temperature zones which result in incomplete retorting of the hydrocarbon-containing solid. Furthermore, in such processes, the solids gravitate to the lower portion of the vessel. Thus, stripping the retorted shale with gas causes lower product yields due to adsorption of a portion of the evolved hydrocarbons by the retorted solids. Generally, indirectly heated surface retorting processes result in higher yields and less dilution of the retorted product than directly heated surface retorting processes, but at the expense of additional materials handling.

Surface retorting processes with moving beds are typified by the Lurgi coal gasification process in which crushed coal is fed into the top of a moving bed gasification zone and upflowing steam endothermically reacts with the coal. In such a process, a portion of the char combusts with oxygen below the gasification reaction zone to supply the required heat of reaction. Moving bed processes are generally disadvantageous because the solids residence time is usually long, necessitating either reactors with very large contact or reaction zones or a large number of smaller reactors. Moreover, moving bed processes often cannot tolerate excessive amounts of fines.

Surface retorting processes with entrained beds are typified by the Koppers-Totzek coal process in which coal is dried, finely pulverized and injected into a treatment zone along with steam and oxygen. The coal is rapidly partially combusted, gasified, and entrained by the hot gases. Residence time of the coal in the reaction zone is only a few seconds. Entrained bed processes are disadvantageous because they require large quantities of hot gases to rapidly heat the solids and often require the raw feed material to be finely pulverized before processing.

Fluid bed surface retorting processes may, depending on the properties of the feed and the processing requirements, be particularly advantageous. The use of fluidized bed contacting zones has long been known in the art and has been widely used in the fluid catalytic cracking of hydrocarbons. When a fluid is passed at a sufficiently high velocity, upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is known as the "minimum fluidization velocity." The velocity of the fluid at which the solid becomes entrained in the fluid is known as the "terminal velocity" or "entrainment velocity." Between the minimum fluidization velocity and the terminal velocity, the bed of solids is in a fluidized state and it exhibits the appearance and some of the characteristics of a boiling liquid. Because of the quasi-fluid or liquid-like state of the solids, there is typically a rapid overall circulation of all the solids throughout the entire bed with substantially complete mixing, as in a stirred-tank reaction system. Such rapid circulation is particularly advantageous in processes in which a uniform temperature and reaction mixture is desired throughout the contacting zone.

Many of these kerogen recovery processes remove the minerals from the oil shale prior to retorting. This removal step is commonly known as beneficiation. Beneficiation can take the form of chemical separation, physical separation, or both. Chemical separation can include leaching of mineral matter or extracting kerogen. Physical separation can include separating kerogen from mineral matter based on density, size, or surface property differences between kerogen and mineral matter. Although the specific gravity difference between pure kerogen and mineral matter can be as high as 2.8 g/cm$^3$, taking advantage of this difference by isolating pure kerogen from mineral matter is very difficult and expensive because the kerogen exists in most oil shale as discrete deposits embedded in large amounts of mineral matter. Therefore, as a practical matter, the separation process involves separating kerogen-rich particles from mineral-rich particles. The density difference between kerogen-rich particles and mineral-rich particles is usually less than about 1 g/cm$^3$.

Many methods of separating kerogen-rich particles from mineral-rich particles require that the oil shale be comminuted to a fine particle size in order to achieve an effective separation. Two examples of such methods are froth flotation and oil agglomeration. Froth flotation involves mixing the comminuted oil shale particles with an aerated aqueous solution. The aqueous solution contains a frother which reduces the surface tension of the solution, thereby producing a froth, and a collector to facilitate absorption of air bubbles at the kerogen-rich surfaces. The air bubbles preferentially absorb at kerogen-rich surfaces which have a greater hydrophobic character than mineral-rich surfaces. Absorbed air bubbles decrease the apparent density of the kerogen-rich particle, thereby causing them to float. A typical maximum particle size of oil shale particles treated by froth flotation is about 32–350 mesh screen size. Oil agglomeration involves mixing oil shale particles with a two phase liquid mixture of organic and aqueous phase. Kerogen-rich particles form agglomerates in the organic phase and mineral-rich particles form suspensions in the aqueous phase. A typical maximum particle size of oil shale particles used in oil agglomeration is about 100 mesh.

Because of the gum-like nature of kerogen, comminuting kerogen-rich particles to the fine particle sizes required by some of the beneficiation methods discussed above can be very expensive.

Spiral separators or concentrators are well known in the art for separating carbonaceous material from mineral matter in coal. This separation is based primarily on the specific gravity differentials of the carbonaceous material and the mineral matter. Raw coal is a physical mixture of carbonaceous material with a specific gravity range of 1.20 to 1.70 g/cm$^3$ and mineral matter with a specific gravity range of about 5.0 g/cm$^3$. Unlike oil shale which consists of discrete deposit of kerogen surrounded by a large amount of mineral matter, coal consists of a large amount of carbonaceous material surrounding a relatively small amount of mineral matter. In addition, the grain size of the mineral matter in coal is larger than the grain size of the kerogen in oil shale. As a result, separating the coal into its relatively pure carbonaceous and mineral components by comminuting the coal, forming a coal slurry, and separating these components from the slurry using a spiral separator has proven to be effective.

SUMMARY OF THE INVENTION

The present invention is a method of beneficiating oil shale, comprising the steps of: comminuting said oil shale in the presence of a first liquid to form a first stream comprising a first group of kerogen-rich particles, a first group of mineral-rich particles, and said first liquid, said kerogen-rich particles having a specific gravity less than that of said mineral-rich particles; flowing said stream in a downward helical course such that said stream is confined in a manner to give said first stream an outer and upper side having a first depth and comprising kerogen-rich particles, and an inner and lower side having a second depth and comprising mineral-rich particles, said first depth being greater than said second depth; separating said kerogen-rich particles from said mineral-rich particles; and retorting said kerogen-rich particles. Applicants have discovered that, in spite of small differences in specific gravities between kerogen-rich and mineral-rich oil shale particles contained in oil shale, the use of a spiral separator to separate these particles prior to retorting can be cost effective. Applicants have also discovered that the use of a spiral separator can produce a kerogen-rich product stream that is concentrated enough in terms of kerogen content to send directly to a retort, therefore the amount of mineral-rich oil shale that requires further beneficiation is reduced.

In another embodiment, the present invention is a method of beneficiating oil shale, comprising the steps of: comminuting said oil shale with at least one semi-autogenous mill in the presence of a first liquid comprising water to form a first stream comprising a first group of kerogen-rich particles, a first group of mineral-rich particles, and said first liquid, said kerogen-rich and mineral-rich particles having a difference in specific gravities of less than about 1 g/cm$^3$.; flowing said first stream in a downward helical course such that said stream is confined in a manner to give said stream an outer and upper side having a first depth and comprising kerogen-rich particles, and an inner and lower side having a second depth and comprising said mineral-rich particles, said first depth being greater than said second depth; separating said kerogen-rich particles from said mineral-rich particles; retorting said kerogen-rich particles; comminuting said first group of mineral-rich particles with at least one ball mill in the presence of a second liquid comprising water to form a second stream comprising a second group of kerogen-rich particles, a second group of mineral-rich particles, and said second liquid; contacting said second stream with a frothing agent to form a frothing mixture; and treating said mixture by froth flotation, whereby air bubbles adhere to the second kerogen-rich particles, thereby causing said second group of kerogen-rich particles to float above said frothing mixture and form a kerogen-rich froth and a mineral-rich mixture; separating said kerogen-rich froth from said mineral-rich mixture; and recovering said second group of kerogen-rich particles from said froth. By combining the use of a spiral separator with froth flotation, a significant amount of the raw oil shale feed can be concentrated and recovered without having to comminute the all of the raw oil shale to fine particle sizes. As a result, a significant cost savings can be achieved.

BRIEF DESCRIPTION OF THE INVENTION

Figure 1:
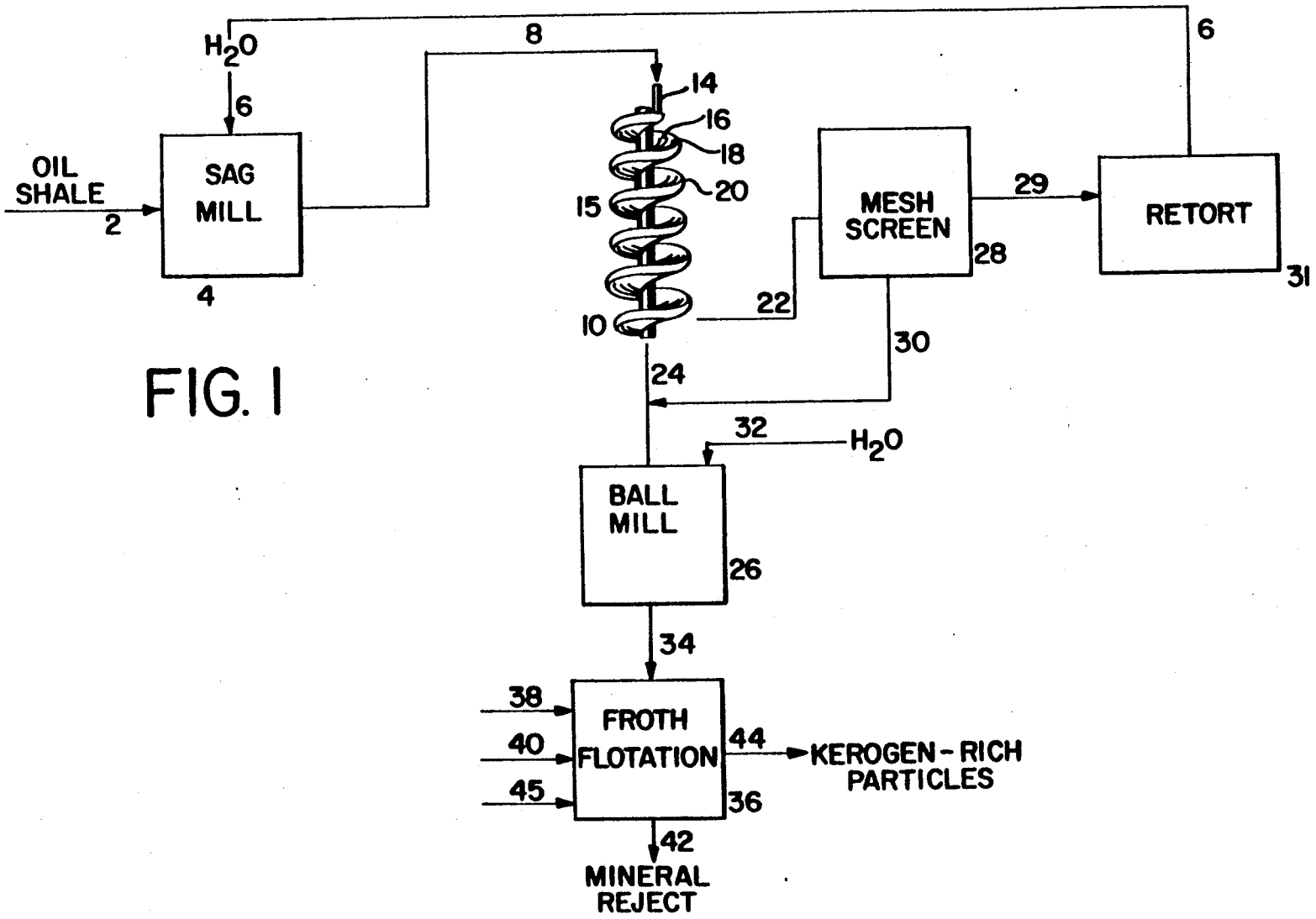
FIG. 1 is a schematic flow diagram of one embodiment of the process of the present invention.

The present invention is a method of beneficiating oil shale wherein raw oil shale particles are comminuted to form a stream comprising kerogen-rich and mineral-rich particles. This stream flows along a downward, helical path that separates the kerogen-rich particles from the mineral-rich particles. The kerogen-rich particles are subsequently retorted.

An essential feature of the present invention is comminuting the raw oil shale in the presence of a first liquid to form a first stream comprising a first group of kerogen-rich particles, a first group of mineral-rich particles, and the first liquid. The kerogen-rich particles have a specific gravity less than that of the mineral rich particles. In one embodiment, the difference in specific gravities between the kerogen-rich and mineral-rich particles is less than about 1 g/cm$^3$. In another embodiment, the difference in specific gravities between the kerogen-rich particles and the mineral-rich particles is less than about 0.5 g/cm$^3$. Equipment suitable for comminuting the oil shale include, but are not limited to, hammer mills, vibratory crushers, cage mills, autogenous mills, and semi-autogenous mills. In a preferred embodiment, the oil shale is comminuted using a semi-autogenous mill to produce kerogen-rich and mineral-rich particles having an average particle size of less than 6 mesh. In some cases a plurality of mills in parallel may be required. The comminuting scheme can be closed loop or open loop. The first liquid can be organic or aqueous, and can be at ambient conditions or heated above ambient temperature. In a preferred embodiment, the first liquid is aqueous and is maintained at a temperature of about 70°-200° F. A suitable source of heat for said first liquid would be waste heat generated by the upstream retorting process.

Another essential feature of the present invention is causing the first liquid stream to flow in a downward helical course such that the stream is confined in a manner to give the stream an outer and upper side having a first depth and comprising kerogen-rich particles, and an inner and lower side having a second depth and comprising mineral-rich particles, said first depth being greater than said second depth.

In one embodiment, the first group of mineral-rich particles are further processed by comminuting said mineral-rich particles with at least one ball mill in the presence of a second liquid comprising water to form a second stream comprising a second group of kerogen-rich particles, a second group of mineral-rich particles, and said second liquid. The second stream is then contacted with a frothing agent to form a frothing mixture, and treated by froth flotation whereby air bubbles adhere to the second group of kerogen-rich particles, thereby causing the second group of kerogen-rich particles to float above the frothing mixture and form a kerogen-rich froth and a mineral-rich mixture. Finally, the kerogen-rich mixture is separated from the mineral-rich mixture and subsequently recovered.

In the froth flotation step, the second stream can be varied by addition or removal of the second liquid to achieve a solid concentration of about 2 to 50 wt % based on the weight of the stream. In a preferred embodiment, the solids concentration can be about 5-30 wt %. The preferred air rate is from about 0.2 cubic feet per minute to 8 cubic feet per minute. The pH of the second stream can vary from 2 to 14 and can be controlled using known acids or bases. The pH of the second stream is important because, varying the pH of the second stream can result in different grades and recoveries of the final product. The preferred froth flotation residence time is approximately about 1 to 25 minutes, more preferably about 2 to 20 minutes. Grade and recovery of the final product can also be effected by changes in residence time. Bubble size can also have an effect on the selectivity and grade of the final product. Ordinarily the smaller the bubbles the better the recovery.

Collectors and frothers can be added to improve effectiveness of the process. Collectors are organic chemicals that selectively concentrate on the solid-liquid interface and render the selected particle surface more hydrophobic. For collecting carbonaceous material, such as kerogen, neutral hydrocarbon oils are the most common collector. Frothers are surface-active chemicals, which form froth in which the hydrophobic materials are retained. Frothers provide different froth stability and bubble sizes which can affect the flotation rate selectivity, and size of particles that it can carry. The three main groups of frothers are alcohols alkoxy-type materials, and polypropylene glycol ethers. Other frothers suitable for use in the present invention include alcohol-polyglycol, glycerol-polyglycol, and esters.

In a preferred process of the present invention, as illustrated in FIG. 1, raw oil shale particles having a kerogen content of at least about 10 gallons per ton of shale and average particle size of not more than about 12 inches in diameter are fed in stream 2 to a semi-antogenous (SAG) mill 4. The SAG mill 4 reduces the average particle size of the oil shale particle to less than about 6 mesh. Heated water is fed into the SAG mill 4 in stream 6. Applicants have discovered that grinding oil shale in the presence of heated water can reduce the power consumption by 50%. The source for the heated water stream 6 is the downstream retorting process 31. The preferred temperature of the water stream 6 can be about 70°-200° F. Accordingly, the presence of the downstream retorting process and its integration into the spiral separator beneficiation process through the use of the waste heat that is available provides a significant reduction in the overall oil shale processing cost that would not otherwise be available.

The effluent stream 8 comprising kerogen-rich particles, mineral-rich particles, and water exits the SAG mill 4 and enters the spiral separator. The spiral separator 10 has a central tubular column 12 and feed pipe 14 through which the effluent stream 8 is passed into the top of the separator 10. The solids concentration of the effluent feed stream 8 can be varied by the addition or removal of water from the stream prior to entering the feed pipe 14. A suitable solids concentration can be about 3–50 wt % based on the weight of the effluent stream 8. The spiral separator 10 further consists of a plurality of helical troughs 15 supported about the column 12. Each trough 15 comprises an upwardly facing surface including a radially outer part 18. The inner part 16 is substantially straight inclining upwardly from the inside to the outside of the trough 15 at an angle of at least about 10° to 25°. This angle can be constant or vary from trough 15 to trough 15. The outer part 18 leads up through a small radius curve to a substantially vertical outside wall 20 of the trough 15. The effluent stream 8 is fed into the feed pipe at a rate of about 0.5 to 10 ton per hour. The effluent stream 8 flows from the feed pipe into the trough 15 and is confined in a manner to give said stream an outer and upper side immediately adjacent to the outer part 18 and a lower and inner side immediately adjacent the inner part 16. The outer and upper side of stream 8 comprising kerogen-rich particles and water has a depth that is greater than that of the inner and lower side of stream 8. The inner and lower side of stream 8 comprises mineral-rich particles and water. As the stream 8 passes down the spiral separator 10 from upper to lower troughs 15, the concentration of kerogen-rich particles in the outer and upper side of stream 8 and the concentration of the mineral-rich particles in the inner and lower side of stream 8. The outer and upper side of stream 8 exits the spiral separator 10 in stream 22. The inner and lower side exits the spiral separator in stream 24. Water can be added to the spiral separator 10. In addition more than one spiral separator 10 can be used in series.

Stream 22 is fed into a screen separator 28 where kerogen-rich particles having an average particle size of less than about 65 mesh are separated in stream 30 and mixed with stream 24 which comprises a substantial amount of mineral-rich particles and at least a portion of kerogen-rich particles prior to being fed to ball mill 26. For those kerogen-rich particles that are larger than about 65 mesh, the concentration of kerogen in the stream 29 should be sufficient to feed to an oil shale retorting process 31. Suitable kerogen concentrations can range from about 15–80 gallons per ton of oil shale. At least about 20–80 wt % of the solids in the effluent stream 8 exits the screen 28 in stream 29. The product grade and the recovery are strongly dependent on the feed grade and the extent of kerogen liberation. This percentage is based on the entire weight of the effluent stream 8.

In the ball mill 26, particles are comminuted to an average particle size of less than about 325 mesh. Water heated to a temperature of about 70°–200° F. can be added to the ball mill 26 in stream 32 to improve grinding efficiency. The source of this water can be the downstream retorting process 31. Stream 34 exits the ball mill 26 and enters a froth flotation separator 36. A frother comprising an polypropylene glycol ether and a collector comprising a kerosene can be added to the froth flotation separator 36 in streams 38 and 40, respectively. A mineral reject stream 42 comprising a substantial amount of the mineral-rich particles entering the froth flotation separator 36 exits the separator 36. A product stream 44 comprising a substantial amount of the kerogen-rich particles entering the separator 36 exits the separator 36. Air is added to the separator 36 in stream 45. Suitable froth flotation process conditions include a solids concentration of the feed of about 5–30 wt % based on the weight of the feed, a pH of about 2–14, an air rate of about 5 cubic feet per minute, and a froth flotation residence time of about 2–20 minutes.

EXAMPLES

The purpose of these Examples was to determine whether a spiral separator could effectively beneficiate kerogen-rich and mineral-rich particles having similar specific gravities.

A total of 13 Examples were run using an oil shale having the physical properties shown below in Table 1.

TABLE 1

| Particle Size Mesh (Tyler) | Oil Shale Wt % | Oil g/t | % Dist Oil |
|---|---|---|---|
| Total | 100.0 | 32.4 | 100.0 |
| +65 | 49.5 | 37.4 | 57.1 |
| −65 + 100 | 5.9 | 33.2 | 6.1 |
| −100 | 44.6 | 26.7 | 36.8 |

Table 2 below summarizes the differences between the specific gravities of the oil shale beneficiated using spiral separators and the spiral separator mineral reject waste stream for each of the upcoming examples. Also included in Table 2 is a summary of the kerogen content of the oil shale before and after the spiral separator beneficiation. Examples 1–6 used a Reichert LD-4r spiral separator having a three (3) turn spiral unit. Examples 7–13 used a Reichert LD-4r spiral separator having a five (5) turn unit.

TABLE 2

| Example Number | Specific Gravity ($g/cm^3$) Beneficiated Oil Shale Product | Mineral Reject Waste | Diff. | Kerogen Content (gal./ton) Feed Oil Shale | Beneficiated Oil Shale |
|---|---|---|---|---|---|
| 1 | 1.77 | 2.16 | 0.39 | 33.23 | 52.84 |
| 2 | 1.87 | 2.17 | 0.30 | 33.23 | 50.66 |
| 3 | 1.82 | 2.29 | 0.47 | 34.97 | 49.23 |
| 4 | 1.84 | 2.26 | 0.42 | 33.80 | 47.82 |
| 5 | 1.84 | 2.19 | 0.35 | 32.67 | 45.76 |
| 6 | 1.87 | 2.19 | 0.32 | 30.45 | 45.76 |
| 7 | 1.84 | 2.29 | 0.45 | 32.10 | 47.82 |
| 8 | 1.80 | 2.20 | 0.40 | 33.23 | 50.66 |
| 9 | 1.82 | 2.23 | 041 | 33.23 | 49.23 |
| 10 | 1.86 | 2.18 | 0.32 | 32.10 | 46.44 |
| 11 | 1.82 | 2.18 | 0.36 | 33.23 | 49.23 |
| 12 | 1.84 | 2.40 | 0.36 | 32.67 | 44.70 |
| 13 | 1.84 | 2.43 | 0.59 | 36.16 | 47.82 |

TABLE 2-continued

| Example Number | Beneficiated Oil Shale Product | Specific Gravity ($g/cm^3$) Mineral Reject Waste | Diff. | Kerogen Content (gal./ton) Feed Oil Shale | Beneficiated Oil Shale |
|---|---|---|---|---|---|
| average | 1.83 | 2.43 | 0.60 | 30.38 | 48.23 |

Table 2 illustrates that a spiral separator is able to increase the kerogen content of oil shale from an average of about 30.38 gal./ton to an average of about 48.23 gal./ton even where the specific gravity difference between the kerogen-rich and mineral-rich particles is less than an average of 0.60 $g/cm^3$.

EXAMPLE 1

The operating conditions included a feed solids concentration of 22.9 wt %, a feed kerogen content of 33.23 g/ton, a feed specific gravity of 2.07 g/cc, a feed rate of 2.5 tons/hr., and a sample time of 5.2 seconds.

The results are shown below in Table 2.

TABLE 3

| Product | Weight % | Solids Rate lb/hr. | % Solids | Analyses Spec. Gravity | Oil g/ton | % Distribution Oil |
|---|---|---|---|---|---|---|
| Beneficiated Shale | (56.5) | 2849 | 13.4 | | | |
| +65 mesh | 20 | 1039 | | 1.77 | 52.84 | 31.6 |
| −65 + 100 mesh | 5.4 | 271 | | 2.04 | 34.97 | 6.5 |
| −100 + 200 mesh | 4.1 | 207 | | 2.06 | 33.81 | 4.0 |
| −200 mesh | 26.4 | 1331 | | 2.24 | 24.32 | 18.6 |
| Middling | (18.40) | 926 | 50.6 | | | |
| +65 mesh | 14.6 | 737 | | 1.94 | 41.12 | 17.5 |
| −65 + 100 mesh | 1.5 | 78 | | 2.06 | 33.81 | 1.5 |
| −100 + 200 mesh | 1.0 | 52 | | 2.2 | 28.84 | 0.9 |
| −200 mesh | 1.2 | 59 | | 2.3 | 23.84 | 0.8 |
| Waste | (25.0) | 1261 | 56.0 | | | |
| +65 mesh | 19.0 | 957 | | 2.16 | 28.32 | 15.6 |
| −65 + 100 mesh | 2.7 | 137 | | 2.24 | 24.32 | 1.9 |
| −100 + 200 mesh | 1.6 | 86 | | 2.30 | 21.55 | 1.1 |
| −200 mesh | 1.6 | 81 | | 2.30 | 21.55 | 1.0 |

EXAMPLE 2

The operating conditions included a feed solids concentration of 19.6 wt %, based on the weight of the feed slurry, a feed kerogen content of 33.23 g/ton, a feed specific gravity of 2.07 g/cc, a feed rate of 2.1 tons/hr., and a sample time of 5.2 seconds.

The results are shown below in Table 4.

TABLE 4

| Product | Weight % | Solids Rate lb/hr. | % Solids | Analyses Spec. Gravity | Oil g/ton | % Distribution Oil |
|---|---|---|---|---|---|---|
| Beneficiated Shale | (60.1) | 2488 | 12.9 | | | |
| +65 mesh | 16.2 | 671 | | 1.870 | 50.66 | 23.6 |
| −65 + 100 mesh | 5.2 | 217 | | 1.95 | 40.48 | 6.1 |
| −100 + 200 mesh | 7.6 | 313 | | 2.19 | 26.78 | 5.8 |
| −200 mesh | 31.1 | 1286 | | 2.06 | 33.71 | 30.2 |
| Middling | (21.4) | 886 | 48.2 | | | |
| +65 mesh | 16.0 | 661 | | 2.04 | 34.97 | 16.0 |
| −65 + 100 mesh | 2.1 | 86 | | 2.15 | 28.84 | 1.7 |
| −100 + 200 mesh | 1.4 | 59 | | 2.24 | 24.32 | 1.0 |
| −200 mesh | 1.9 | 80 | | 2.29 | 22.00 | 1.2 |
| Waste | (18.5) | 768 | 44.6 | | | |
| +65 mesh | 14.2 | 590 | | 2.17 | 27.80 | 11.4 |
| −65 + 100 mesh | 1.4 | 59 | | 2.22 | 25.28 | 1.0 |
| −100 + 200 mesh | 1.1 | 44 | | 2.24 | 24.32 | 0.7 |
| −200 mesh | 1.8 | 74 | | 2.25 | 23.84 | 1.2 |

EXAMPLE 3

The operating conditions included a feed solids concentration of 19.6 wt %, based on the weight of the feed slurry, a feed kerogen content of 34.97 g/ton, a feed specific gravity of 2.04 g/cc, a feed rate of 2.0 tons/hr., and a sample time of 5.4 seconds.

The results are shown below in Table 5.

TABLE 5

| Product | Weight % | Solids Rate lb/hr. | % Solids | Analyses Spec. Gravity | Oil g/ton | % Distribution Oil |
|---|---|---|---|---|---|---|
| Beneficiated Shale | (61.7) | 2516 | 12.1 | | | |
| +65 mesh | 24.5 | 998 | | 1.82 | 49.23 | 35.8 |

TABLE 5-continued

| Product | Weight % | Solids Rate lb/hr. | % Solids | Analyses Spec. Gravity | Analyses Oil g/ton | % Distribution Oil |
|---|---|---|---|---|---|---|
| −65 + 100 mesh | 3.2 | 132 | | 1.94 | 41.12 | 4.0 |
| −100 + 200 mesh | 6.2 | 253 | | 2.04 | 34.97 | 6.4 |
| −200 mesh | 27.8 | 1133 | | 2.23 | 24.80 | 20.4 |
| Middling | (35.2) | 1433 | 54.9 | | | |
| +65 mesh | 28.9 | 1179 | | 2.11 | 30.99 | 26.6 |
| −65 + 100 mesh | 2.8 | 113 | | 2.18 | 27.28 | 2.2 |
| −100 + 200 mesh | 1.8 | 72 | | 2.26 | 23.37 | 1.2 |
| −200 mesh | 1.7 | 69 | | 2.28 | 22.45 | 1.1 |
| Waste | (3.2) | 130 | 37.8 | | | |
| +65 mesh | 2.3 | 94 | | 2.29 | 22.00 | 1.5 |
| −65 + mesh | 0.5 | 19 | | 2.25 | 23.84 | 0.3 |
| −100 + 200 mesh | 0.2 | 9 | | 2.14 | 29.37 | 0.2 |
| −200 mesh | 0.2 | 8 | | 2.15 | 28.84 | 0.2 |

EXAMPLE 4

The operating conditions included a feed solids concentration of 18.8 wt %, based on the weight of the feed slurry, a feed kerogen content of 33.8 g/ton, a feed specific gravity of 2.06 g/cc, a feed rate of 2.1 tons/hr., and a sample time of 5.3 seconds.

The results are shown below in Table 6.

TABLE 6

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (62.3) | 2612 | 13.0 | | | |
| +65 mesh | 24.0 | 1007 | | 1.84 | 47.82 | 35.0 |
| −65 + 100 mesh | 3.5 | 145 | | 1.95 | 40.48 | 4.3 |
| −100 mesh | 34.5 | 1460 | | 2.22 | 25.28 | 26.8 |
| Middling | (28.5) | 1196 | 53.4 | | | |
| +65 mesh | 22.1 | 928 | | 2.07 | 33.23 | 22.4 |
| −65 + 100 mesh | 2.4 | 102 | | 2.14 | 29.37 | 2.2 |
| −100 mesh | 4.0 | 63 | | 2.28 | 22.45 | 1.0 |
| Waste | (9.3) | 387 | 53.4 | | | |
| +65 mesh | 7.0 | 293 | | 2.26 | 23.37 | 5.0 |
| −65 + 100 mesh | 0.8 | 32 | | 2.21 | 25.78 | 0.6 |
| −100 mesh | 1.5 | 63 | | 2.28 | 22.45 | 1.0 |

EXAMPLE 5

The operating conditions included a feed solids concentration of 19.0 wt%, based on the weight of the feed slurry, a feed kerogen content of 32.67 g/ton, a feed specific gravity of 2.08 g/cc, a feed rate of 2.6 tons/hr., and a sample time of 5.3 seconds.

The results are shown below in Table 7.

TABLE 7

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (53.8) | 2764 | 14.5 | | | |
| +65 mesh | 20.6 | 1059 | | 1.84 | 47.82 | 30.7 |
| −65 + 100 mesh | 4.4 | 220 | | 2.08 | 32.67 | 4.5 |
| −100 mesh | 28.8 | 1480 | | 2.29 | 26.78 | 24.0 |
| Middling | (24.2) | 1244 | 54.7 | | | |
| +65 mesh | 19.3 | 993 | | 2.09 | 32.10 | 19.3 |
| −65 + 100 mesh | 1.6 | 84 | | 2.20 | 26.27 | 1.3 |
| −100 mesh | 3.3 | 168 | | 2.31 | 21.11 | 2.1 |
| Waste | (22.2) | 1137 | 50.7 | | | |
| +65 mesh | 17.6 | 905 | | 2.19 | 26.78 | 14.7 |
| −65 + 100 mesh | 1.3 | 64 | | 2.25 | 23.84 | 0.9 |
| −100 mesh | 3.3 | 168 | | 2.28 | 22.45 | 2.3 |

EXAMPLE 6

The operating conditions included a feed solids concentration of 12.4 wt%, based on the weight of the feed slurry, a feed kerogen content of 30.45 g/ton, a feed specific gravity of 2.12 g/cc, a feed rate of 1.4 tons/hr., and a sample time of 5.3 seconds.

The results are shown below in Table 8.

TABLE 8

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (55.7) | 1604 | 8.4 | | | |
| +65 mesh | 17.9 | 516 | | 1.87 | 45.76 | 25.9 |
| −65 + 100 mesh | 3.2 | 92 | | 1.97 | 39.22 | 4.0 |

TABLE 8-continued

| Product | Weight % | Solids Rate lb/hr. | % Solids | Analyses Spec. Gravity | Analyses Oil g/ton | % Distribution Oil |
|---|---|---|---|---|---|---|
| −100 mesh | 34.6 | 996 | | 2.20 | 26.27 | 28.7 |
| Middling | (23.7) | 684 | 41.6 | | | |
| +65 mesh | 19.5 | 561 | | 2.04 | 34.97 | 21.5 |
| −65 + 100 mesh | 0.3 | 9 | | 2.18 | 27.28 | 0.3 |
| −100 mesh | 3.9 | 114 | | 2.29 | 22.00 | 2.7 |
| Waste | (20.5) | 592 | 37.7 | | | |
| +65 mesh | 16.7 | 482 | | 2.19 | 26.78 | 14.2 |
| −65 + 100 mesh | 0.6 | 19 | | 2.29 | 22.00 | 0.4 |
| −100 mesh | 3.2 | 92 | | 2.29 | 22.00 | 2.2 |

EXAMPLE 7

The operating conditions included a feed solids concentration of 17.7 wt%, based on the weight of the feed slurry, a feed kerogen content of 32.10 g/ton, a feed specific gravity of 2.09 g/cc, a feed rate of 2.1 tons/hr., and a sample time of 5.3 seconds.

The results are shown below in Table 9.

TABLE 9

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (66.0) | 2823 | 14.0 | | | |
| +65 mesh | 27.4 | 1172 | | 1.84 | 47.82 | 40.4 |
| −65 + 100 mesh | 4.4 | 186 | | 2.01 | 36.76 | 4.9 |
| −100 mesh | 34.2 | 1465 | | 2.23 | 24.80 | 26.2 |
| Middling | (21.8) | 929 | 55.3 | | | |
| +65 mesh | 17.7 | 755 | | 2.10 | 30.45 | 1.4 |
| −65 + 100 mesh | 1.5 | 62 | | 2.12 | 30.45 | 1.4 |
| −100 mesh | 2.6 | 111 | | 2.25 | 23.84 | 1.9 |
| Waste | (12.3) | 525 | 49.3 | | | |
| +65 mesh | 8.2 | 353 | | 2.29 | 22.00 | 5.6 |
| −65 + 100 mesh | 1.5 | 63 | | 2.30 | 21.55 | 1.0 |
| −100 mesh | 2.6 | 110 | | 2.35 | 19.39 | 1.5 |

EXAMPLE 8

The operating conditions included a feed solids concentration of 24.6 wt%, based on the weight of the feed slurry, a feed kerogen content of 33.23 g/ton, a feed specific gravity of 2.07 g/cc, a feed rate of 1.9 tons/hr., and a sample time of 5.2 seconds.

The results are shown below in Table 10.

TABLE 10

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | | | 14.9 | | | |
| +65 mesh | 20.0 | 755 | | 1.80 | 50.66 | 30.1 |
| −65 + 100 mesh | 1.4 | 52 | | 1.90 | 43.74 | 1.8 |
| −100 + 200 mesh | 3.3 | 1.15 | | 2.02 | 36.16 | 3.6 |
| −200 mesh | 19.0 | 717 | | 2.19 | 26.78 | 15.1 |
| Middling | 13.9 | 523 | 49.7 | 1.96 | 39.85 | 16.4 |
| Waste | 42.3 | 1595 | 57.9 | 2.20 | 26.27 | 33.0 |

EXAMPLE 9

The operating conditions included a feed solids concentration of 22.9 wt%, based on the weight of the feed slurry, a feed kerogen content of 33.23 g/ton, a feed specific gravity of 2.07 g/cc, a feed rate of 2.3 tons/hr., and a sample time of 5.2 seconds.

The results are shown below in Table 11.

TABLE 11

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | | | 16.1 | | | |
| +65 mesh | 23.3 | 1086 | | 1.82 | 49.23 | 34.8 |
| −65 + 100 mesh | 3.7 | 171 | | 1.97 | 39.22 | 4.4 |
| −100 + 200 mesh | 4.4 | 107 | | 2.06 | 33.81 | 4.6 |
| −200 mesh | 22.2 | 1035 | | 2.24 | 24.32 | 16.4 |
| Middling | 12.8 | 598 | 53.4 | 2.00 | 37.37 | 14.5 |
| Waste | 33.6 | 1571 | 58.1 | 2.23 | 24.80 | 25.4 |

EXAMPLE 10

The operating conditions included a feed solids concentration of 22.9 wt%, based on the weight of the feed slurry, a feed kerogen content of 32.10 g/ton, a feed specific gravity of 2.07 g/cc, a feed rate of 0.8 tons/hr., and a sample time of 5.2 seconds.

The results are shown below in Table 12.

TABLE 12

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (53.2) | 887 | 4.3 | | | |
| +65 mesh | 29.2 | 487 | | 1.86 | 46.44 | 37.4 |
| −65 + 100 mesh | 7.1 | 118 | | 1.97 | 39.22 | 7.5 |
| −100 + 200 mesh | 8.0 | 134 | | 2.05 | 34.39 | 7.6 |
| −200 mesh | 8.0 | 148 | | 2.26 | 23.37 | 5.7 |
| Middling | (19.2) | 320 | 36.3 | | | |
| +65 mesh | 16.3 | 271 | | 1.92 | 42.42 | 19.0 |
| −65 + 100 mesh | 1.4 | 23 | | 2.03 | 35.56 | 1.3 |
| −100 + 200 mesh | 1.1 | 18 | | 2.10 | 31.55 | 1.0 |
| −200 mesh | 0.4 | 7 | | 2.22 | 25.28 | 0.3 |
| Waste | (27.6) | 461 | 41.4 | | | |
| +65 mesh | 20.8 | 348 | | 2.18 | 27.28 | 15.7 |
| −65 + 100 mesh | 3.7 | 62 | | 2.24 | 24.32 | 2.5 |
| −100 + 200 mesh | 2.3 | 38 | | 2.26 | 23.37 | 1.5 |
| −200 mesh | 0.8 | 14 | | 2.30 | 21.55 | 0.5 |

EXAMPLE 11

The operating conditions included a feed solids concentration of 22.9 wt%, based on the weight of the feed slurry, a feed kerogen content of 32.10 g/ton, a feed specific gravity of 2.09 g/cc, a feed rate of 0.8 tons/hr., and a sample time of 5.2 seconds.

The results are shown below in Table 13.

TABLE 13

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (54.2) | 887 | 4.3 | | | |
| +65 mesh | 29.2 | 487 | | 1.86 | 46.44 | 37.4 |
| −65 + 100 mesh | 7.1 | 118 | | 1.97 | 39.22 | 7.6 |
| −100 + 200 mesh | 8.0 | 134 | | 2.05 | 34.39 | 7.0 |
| −200 mesh | 8.9 | 148 | | 2.26 | 23.37 | 5.7 |

EXAMPLE 12

The operating conditions included a feed solids concentration of 19.6 wt%, based on the weight of the feed slurry, a feed kerogen content of 32.67 g/ton, a feed specific gravity of 2.08 g/cc, a feed rate of 2.5 tons/hr., and a sample time of 5.2 seconds.

The results are shown below in Table 14.

TABLE 14

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (67.9) | 3348 | 15.4 | | | |
| +65 mesh | 31.3 | 1545 | | 1.84 | 47.82 | 44.7 |
| −65 + 100 mesh | 4.7 | 230 | | 1.99 | 37.98 | 5.3 |
| −100 + 200 mesh | 7.1 | 350 | | 2.11 | 30.99 | 6.6 |
| −200 mesh | 24.8 | 1223 | | 2.26 | 23.37 | 17.3 |
| Middling | (27.3) | 1348 | 56.8 | | | |
| +65 mesh | 23.2 | 1147 | | 2.14 | 29.37 | 20.4 |
| −65 −100 mesh | 1.6 | 77 | | 2.17 | 27.80 | 1.3 |
| −100 + 200 mesh | 1.2 | 59 | | 2.24 | 24.32 | 0.9 |
| −200 mesh | 1.3 | 66 | | 2.30 | 21.55 | 0.9 |
| Waste | (4.8) | 240 | 47.2 | | | |
| +65 mesh | 3.1 | 153 | | 2.40 | 17.37 | 1.6 |
| −65 + 100 mesh | 0.6 | 29 | | 2.33 | 20.24 | 0.4 |
| −100 + 200 mesh | 0.6 | 32 | | 2.36 | 18.98 | 0.4 |
| −200 mesh | 0.5 | 26 | | 2.33 | 20.24 | 0.3 |

EXAMPLE 13

The operating conditions included a feed solids concentration of 23.2 wt %, based on the weight of the feed slurry, a feed kerogen content of 36.16 g/ton, a feed specific gravity of 2.02 g/cc, a feed rate of 2.6 tons/hr., and a sample time of 5.3 seconds.

The results are shown below in Table 15.

TABLE 15

| Product | Weight % | Solids Rate lb/hr. | % Solids | Analyses Spec. Gravity | Analyses Oil g/ton | % Distribution Oil |
|---|---|---|---|---|---|---|
| Beneficiated Shale | (60.7) | 3222 | 16.4 | | | |
| +65 mesh | 31.4 | 1666 | | 1.84 | 47.82 | 43.2 |

TABLE 15-continued

| Product | Weight % | Solids Rate lb/hr. | % Solids | Analyses Spec. Gravity | Analyses Oil g/ton | % Distribution Oil |
|---|---|---|---|---|---|---|
| −65 + 100 mesh | 2.5 | 134 | | 2.10 | 31.55 | 2.3 |
| −100 | 25.8 | 1422 | | 2.14 | 29.37 | 22.7 |
| Middling | (34.7) | 1842 | 57.6 | | | |
| +65 mesh | 29.2 | 1549 | | 2.12 | 30.45 | 25.6 |
| −65 + 100 mesh | 2.3 | 121 | | 2.15 | 28.84 | 1.9 |
| −100 mesh | 3.2 | 172 | | 2.26 | 23.37 | 2.2 |
| Waste | (4.4) | 234 | 47.9 | | | |
| +65 mesh | 2.9 | 155 | | 2.43 | 16.23 | 1.4 |
| −65 + 100 mesh | 0.5 | 27 | | 2.37 | 18.57 | 0.3 |
| −100 mesh | 1.0 | 52 | | 2.39 | 17.77 | 0.5 |

That which is claimed is:

1. A method of beneficiating oil shale, comprising the steps of:

(a) comminuting said oil shale in the presence of a first liquid to form a first stream comprising a first group of kerogen-rich particles, a first group of mineral-rich particles, and said first liquid, said kerogen-rich particles having a specific gravity less than that of said mineral-rich particles;

(b) flowing said first stream in a downward helical course such that said stream is confined in a manner to give said first stream an outer and upper side having a first depth and comprising a first portion of said kerogen-rich particles, and an inner and lower side having a second depth and comprising said mineral-rich particles and a second portion of said kerogen-rich particles, said first depth being greater than said second depth;

(c) separating said first portion of said kerogen-rich particles from both of said mineral-rich particles and said second portion of said kerogen rich particles (d) retorting said first portion of said kerogen-rich particles;

(e) comminuting said mineral-rich particles and said second portion of said kerogen-rich particles in the presence of a second liquid to form a second stream comprising a second group of kerogen-rich particles, a second group of mineral-rich particles, and a second liquid; and (f) contacting said second stream with a frothing agent to form a frothing mixture and treating said frothing mixture by froth flotation, whereby air bubbles adhere to the second group of kerogen-rich particles, thereby causing said second group of kerogen-rich particles to float above said mixture and form a kerogen-rich froth and a mineral-rich mixture, separating said kerogen-rich froth from said mineral-rich mixture, and recovering said second group of kerogen-rich particles.

2. A method of claim 1 wherein in step (a) the comminution is implemented with at least one semi-autogenous mill.

3. A method of claim 1 wherein in step (a) said first liquid comprises water.

4. A method of claim 3 wherein said liquid is maintained at a temperature about 75°-200° F. and originates as a waste heat stream from step (d).

5. A method of claim 2 wherein in step (a) the average particle size of said kerogen-rich and mineral-rich particles are less than about 6 mesh in diameter.

6. A method of claim 1 wherein in step (e) the comminuting is implemented with at least one ball mill.

7. A method of claim 6 wherein in step (e) the average particle size of the second group of kerogen-rich and mineral-rich particles is less than about 325 mesh in diameter.

8. A method of claim 1 wherein in step (e) said liquid comprises water.

9. A method of claim 8 wherein in step (e) said liquid is maintained at a temperature of not less than about 120° F.

10. A method of beneficiating oil shale, comprising the steps of:

(a) comminuting said oil shale with at least one semi autogenous mill in the presence of a first liquid comprising water to form a first stream comprising a first group of kerogen-rich particles, a first group of mineral-rich particles, and said first liquid, said kerogen-rich and mineral-rich particles having a difference in specific gravities of less than about 1.0 g/cm$^3$;

(b) causing said first stream to flow in a downward helical course such that said stream is confined in a manner to give said stream an outer and upper side having a first depth and comprising a major portion of said kerogen-rich particles, and an inner and lower side having a second depth and comprising said mineral-rich particles and a minor portion of said kerogen-rich particles, said first depth being greater than said second depth;

(c) separating said major portion of said kerogen-rich particles from both of said mineral-rich particles and said minor portion of said kerogen-rich particles;

(d) retorting said major portion of said kerogen-rich particles;

(e) comminuting said mineral-rich particles and said minor portion of said kerogen-rich particles with at least one ball mill in the presence of a second liquid comprising water to form a second stream comprising a second group of kerogen-rich particles, a second group of mineral-rich particles, and said second liquid; and (f) contacting said second stream with a frothing agent to form a frothing mixture, and treating said mixture by froth flotation, whereby air bubbles adhere to the second group of kerogen-rich particles, thereby causing said second group of kerogen-rich particles to float above said frothing mixture and form a kerogen-rich froth and a mineral-rich mixture, separating said kerogen-rich froth from said mineral-rich mixture, and recovering said second group of kerogen-rich particles from said froth.

11. A method of claim 10 wherein in step (a) said first liquid consists essentially of water.

12. A method of claim 10 wherein in step (a) said first liquid is maintained at a temperature range of about 75°-200° F. and originates as a waste stream from step (d).

13. A method of claim 10 wherein in step (a) the average particle size of said first group of kerogen-rich and mineral-rich particles is less than about 6 mesh.

14. A method of claim 10 wherein in step (e) the average particle size of the second group of kerogen-rich and mineral-rich particles is less than about 325 mesh.

15. A method of claim 10 wherein in step (e) said second liquid consists essentially of water.

16. A method of claim 10 wherein in step (e) said second liquid is maintained at a temperature of about 70°-200° F. and originates as waste heat stream from step (d).

17. A method of beneficiating oil shale, comprising the steps of:

(a) comminuting said oil shale particles with at least one semi-autogenous mill to an average particle size of less than about 6 mesh in the presence of first liquid comprising water to form a first stream comprising a first group of kerogen-rich particles, a first group of mineral-rich particles, and said first liquid at a temperature of about 75°-200° F., said kerogen-rich and mineral-rich particles having a difference in specific gravities of less than about 0.6 g/cm$^3$;

(b) causing said first stream to flow in a downward helical course such that said first stream is confined in a manner to give said first stream an outer and upper side having at first depth and comprising a major amount of said kerogen-rich particles, and an inner and lower side having a second depth and comprising a major amount of said mineral-rich particles and a minor amount of said kerogen-rich particles, said first depth being greater than said second depth;

(c) separating said major amount of said kerogen-rich particles from both of said mineral-rich particles and said minor amount of said kerogen-rich particles;

(d) retorting said major amount of said kerogen-rich particles;

(e) comminuting said mineral-rich particles and said minor amount of said kerogen-rich particles with at least one ball mill to an average particle size of less than about 325 mesh in the presence of a second liquid comprising water to form a second stream comprising a second group of kerogen-rich particles, a second group of mineral-rich particles, and said second liquid at a temperature of about 70°-200° F.; and (f) contacting said second stream with a frothing agent to form a frothing mixture and treating said mixture by froth flotation, whereby air bubbles adhere to the second kerogen-rich particles, thereby causing said second group of kerogen-rich particles to float above said mixture and form a kerogen-rich froth and a mineral-rich mixture, separating said kerogen-rich froth from said mineral-rich mixture, and recovering said second group of kerogen-rich particles from said froth.

18. A method of claim 17 wherein in step (a) said first liquid consists essentially of water.

19. A method of claim 17 wherein in step (e) said second liquid consists essentially of water.

* * * * *